US005385159A

United States Patent [19]

Mead

[11] Patent Number: 5,385,159

[45] Date of Patent: Jan. 31, 1995

[54] PARTS WASHER

[76] Inventor: Rodney D. Mead, 17819 670th Ave., Hutchinson, Minn. 55350

[21] Appl. No.: 105,030

[22] Filed: Aug. 11, 1993

[51] Int. Cl.[6] ..... B08B 3/02

[52] U.S. Cl. ..... 134/104.4; 134/111; 134/113; 134/200

[58] Field of Search ..... 134/104.1, 104.4, 111, 134/113, 195, 200, 198, 199, 148

[56] References Cited

U.S. PATENT DOCUMENTS

| | | | |
|---|---|---|---|
| 3,416,544 | 12/1968 | Paiva | 134/111 X |
| 3,960,728 | 6/1976 | Otzen | 134/111 X |
| 3,970,560 | 7/1976 | Metzger | 134/111 X |
| 4,025,363 | 5/1977 | De Santis | 134/200 X |
| 4,052,227 | 10/1977 | Delo et al. | 134/56 R |
| 4,056,114 | 11/1977 | Boutillette | 134/104.4 |
| 4,141,311 | 2/1979 | Taylor, Jr. | 134/113 X |
| 4,170,240 | 10/1979 | Gentry | 134/57 R |
| 4,485,645 | 12/1984 | Mulder et al. | 68/18 F |
| 4,543,182 | 9/1985 | Gramse et al. | 134/111 X |
| 4,785,836 | 11/1988 | Yamamoto | 134/56 R |
| 4,793,369 | 12/1988 | Robb et al. | 134/170 |
| 4,995,409 | 2/1991 | Watts | 134/111 X |
| 5,107,876 | 4/1992 | Ozyjiwsky | 134/200 X |
| 5,213,117 | 5/1993 | Yamamoto | 134/200 X |

OTHER PUBLICATIONS

Grainger Industrial and Commercial Supplies (product catalog), Spring 1993. Exhibit A.

NAPA Product Catalog, Date unknown. Exhibit B.

Product Catalog (Publication unknown), Date unknown. Exhibit C.

Product Catalog (Publication unknown), Date unknown. Exhibit D.

*Primary Examiner*—Philip R. Coe

*Attorney, Agent, or Firm*—Merchant, Gould, Smith, Edell, Welter & Schmidt

[57] ABSTRACT

A parts washer having an upper tank with a sloped bottom portion that slopes downward to an exit aperture and having a pumping mechanism for pumping solvent from the upper tank to a solvent-spraying means. A valve assembly with first and second end portions is attached to the exit aperture such that there is a fluid-tight seal between the first end portion of the valve assembly and the upper tank. A lower tank having a cover, a detachable lower portion, an attachment mechanism for attaching and detaching the lower portion from the cover, and a sealing mechanism for providing an air-tight seal between the cover and the lower portion is attached to the valve assembly such that the cover is attached to the second end portion of the valve assembly so that a fluid-tight seal exists between the cover and the valve assembly.

17 Claims, 2 Drawing Sheets

PARTS WASHER

BACKGROUND OF THE INVENTION

1. Field of the Invention

This invention relates to parts washers and a method for cleaning a parts washer.

2. Description of the Prior Art

Currently, parts washers are used in automotive and other types of repair shops. These devices typically use a tank containing a solvent and a pump mechanism for pumping solvent to a spray nozzle for spraying on the parts. These devices can also contain areas in which parts can be soaked in the solvent. As the parts are washed, the dirt and sludge which is removed from the parts will settle into the solvent tank. Unfortunately, most of the currently-used parts washers have a flat bottom, therefore, the dirt and sludge tends to be stirred up into the solvent by the pump during use.

In addition, after enough dirt or sludge has accumulated in the solvent, the parts washer must be cleaned. Currently, conventional units are cleaned by disposing of all of the solvent. Unfortunately, complete fluid replacement is expensive, requiring the cost of new solvent, the disposal of the solvent, which is an environmentally hazardous material, and the labor that is associated with the removal and disposal of the solvent.

Therefore, there arises a need for a parts washer which removes dirt from the solvent that is being used to clean the parts and which is capable of being easily cleaned without requiring the disposal and replacement of large amounts of solvent.

SUMMARY OF THE INVENTION

The present invention is for a parts washer having an upper tank with a sloped bottom portion that slopes downward to an exit aperture and a pumping mechanism for pumping solvent in the upper tank to a solvent spraying mechanism. A valve assembly with valve means, a first end portion and a second end portion is attached to the exit aperture such that a fluid-tight seal exists between the first end portion of the valve assembly and the upper tank. A lower tank having a cover, a detachable lower portion, an attachment mechanism for attaching and detaching the lower portion to and from the cover, and a sealing mechanism for providing a fluid tight seal between the cover and lower portion is attached to the valve assembly by attaching the cover to the second end portion of the valve assembly.

The present invention meets the need for a parts washer which removes the dirt from the solvent which is used to clean parts by use of an upper tank with a sloped bottom portion, a lower tank and a valve assembly between the upper tank and lower tank. As parts are washed, the dirt and sludge which is removed from the parts will tend to settle into the upper tank. Because the bottom portion of the upper tank is sloped, the dirt and sludge continues to move down the bottom portion through the exit aperture and valve assembly and into the lower tank where the dirt and sludge are not recirculated by the pump. Therefore, the solvent which is used to clean the parts remains free of dirt.

The present invention also meets the need for an easily-cleaned parts washer without the need to remove all of the solvent. Because all of the dirt and sludge is located in the lower tank, only the lower tank needs to be emptied. Therefore the parts washer is easily cleaned by shutting off the valve between the upper and lower tanks to prevent the loss of any solvent from the upper tank. The attachment mechanism would then be detached and the lower portion of the lower tank removed, emptied and then reattached to the cover. The valve can then be opened and a small amount of solvent can be added to the upper tank to replace the solvent which was discarded along with the dirt from the lower tank. Therefore the parts washer is easily cleaned with only a small amount of solvent needing to be replaced.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT

Figure 2:
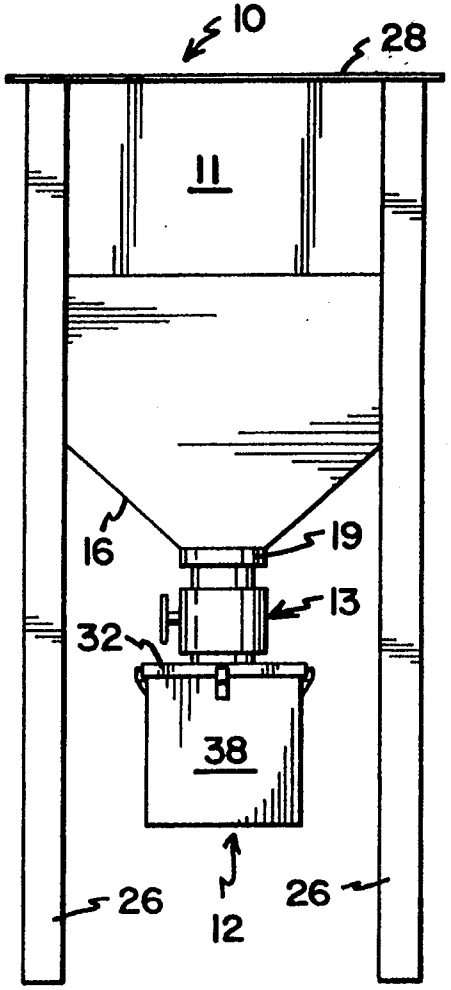
FIG. 2 is a side plan view of the preferred embodiment of the invention.
Figure 1:
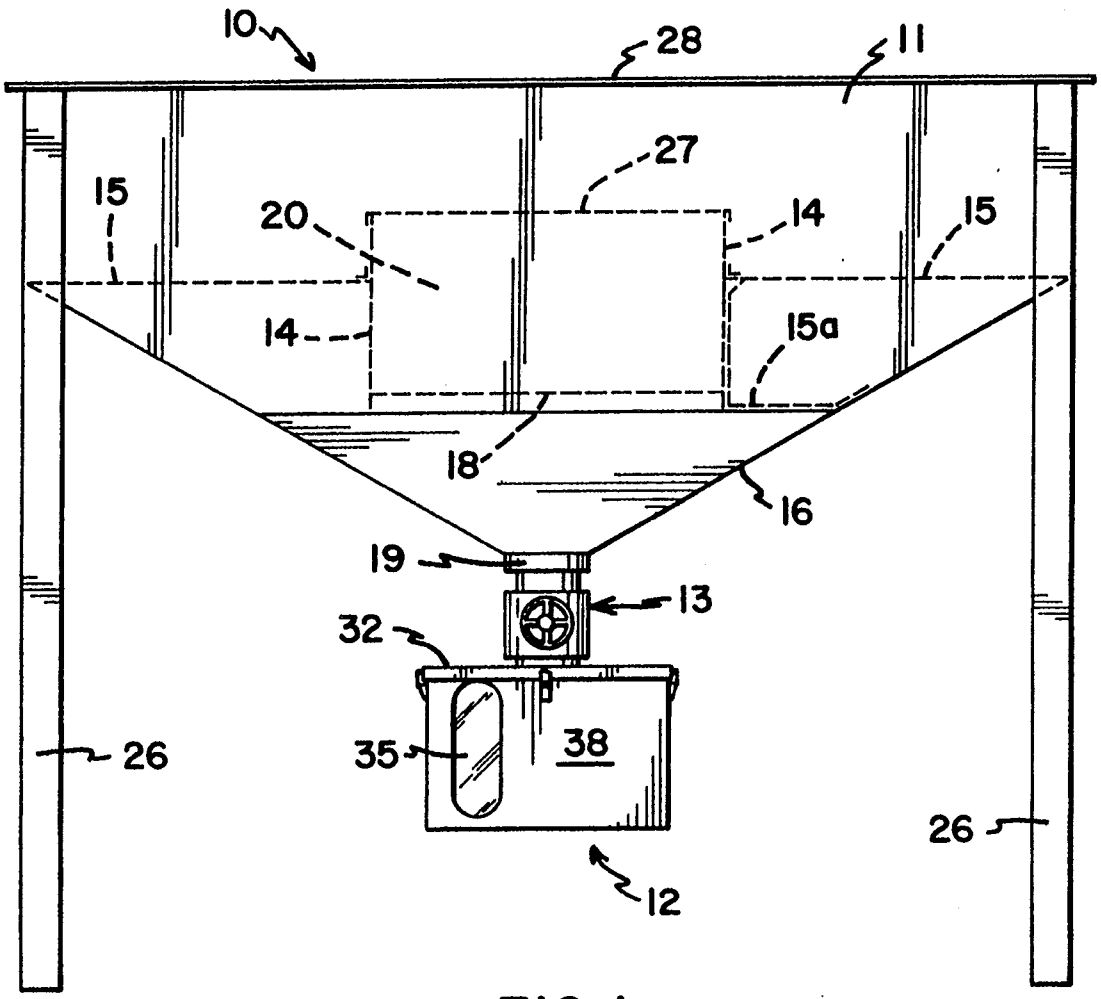
FIG. 1 is a front plan view of the preferred embodiment of the invention.

Referring now to the drawings, wherein like reference numerals designate like parts, the preferred embodiment of the invention is a parts washer, generally designated as 10, having an upper tank 11, a lower tank 12, and a valve assembly 13, FIGS. 1 and 2. The upper tank would have a sloped bottom portion 16 extending downward to a generally centrally located support block 19 with a threaded exit aperture therein. The upper tank 11 would also have a hinged cover 28 which overlaps the upper tank such that the upper tank 11 becomes almost air tight to reduce the evaporation of solvent from the upper tank. To increase durability and to reduce friction on the dirt flow, the upper tank 11 would be made from stainless steel.

Figure 4:
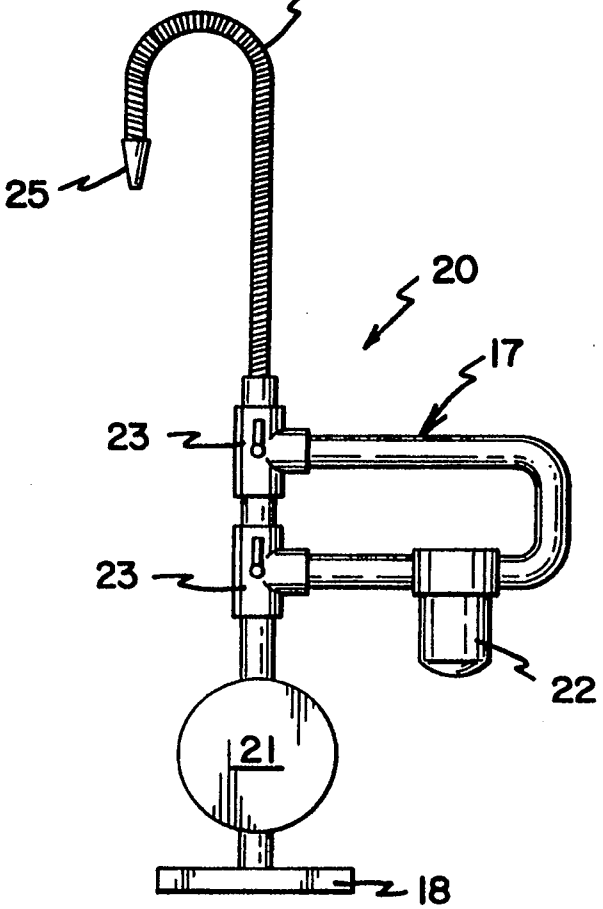
FIG. 4 is a side plan view of the preferred embodiment of the pump assembly for use with the invention.

A pump assembly 20, best shown in FIG. 4, would be mounted to one of the interior surfaces of the upper tank 11. The pump assembly 20 could be any standard pump assembly as used in the art, however, it would preferably contain a submersible pump 21 and a suction screen 18 beneath the inlet to the submersible pump 21. In the preferred embodiment, a 1/32" meshed suction screen 18 would be used to keep large dirt particles below the submersible pump 21 so that the dirt would continue to flow to the lower tank 12.

The exit of the submersible pump 21 would then enter a filter/bypass system 17 which is arranged and configured such that solvent leaving the submersible pump can be sent through a cartridge filter 22 or directly to a flexible hose 24 and spray nozzle 25. If fine dirt might be present in the solvent passing through the submersible pump 21, T-valves 23 would be positioned such that the solvent leaving the submersible pump 21 would pass through the cartridge filter 22 prior to reaching the flexible hose 24. If fine dirt were not likely to be present, the T-valves 23 would be arranged such that the solvent proceeded directly from the submersible pump 21 to the flexible hose 24.

Referring now to FIG. 1, side support plates 14, made from ⅛" thick stainless steel, would be attached to an interior surface of the upper tank 11 and to the suction screen 18 to act as a support for the suction screen 18. The side support plates 14 would also support cleaning screens 15 and a 3/16" thick stainless steel pump cover 27 having an opening for the flexible hose 24. In the preferred embodiment, the cleaning screens 15 would include ¼" reinforced mesh screens that were located above the solvent fluid level and a generally L-shaped reinforced mesh screen 15*a* which was arranged and configured to fit between the side support plate 14 and the interior surface of the upper tank 11 at a position beneath the solvent fluid level so that parts could be soaked.

Figure 3:
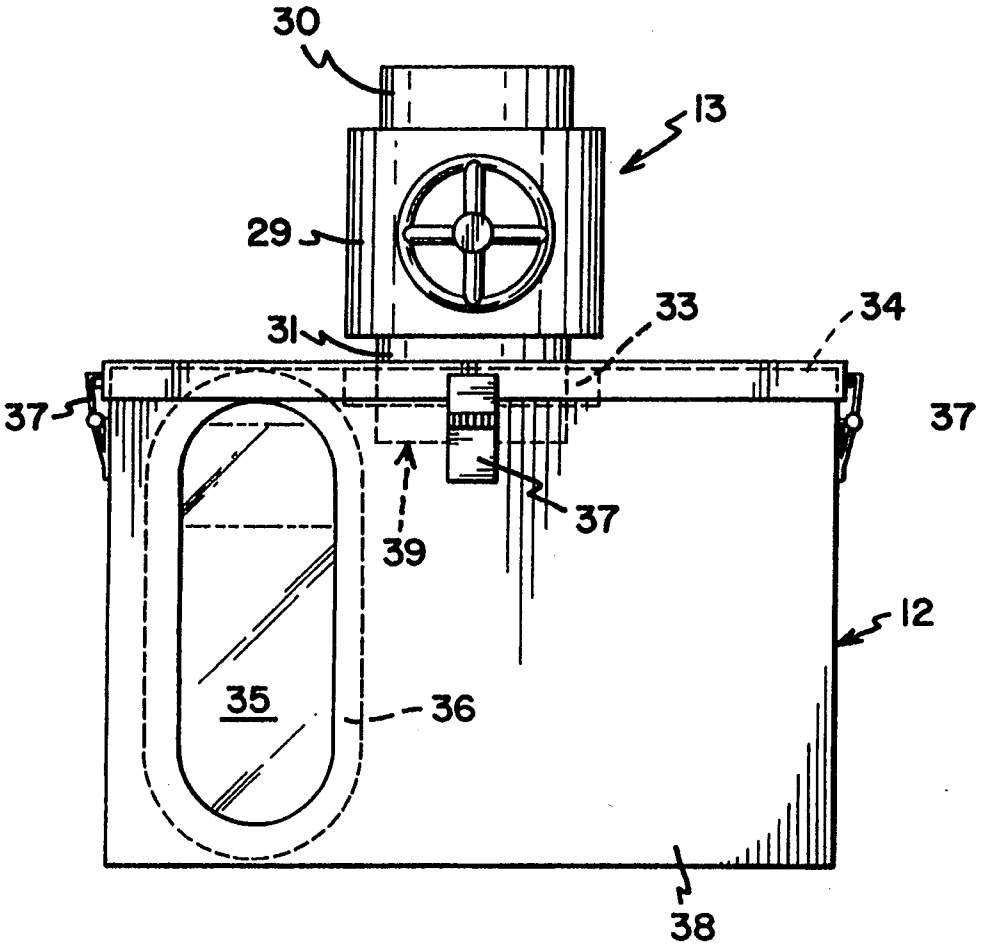
FIG. 3 is a side plan view of the preferred embodiment of the valve assembly and lower tank for use with the invention.

A valve assembly 13, best shown in FIG. 3, having a solvent rated gate valve 29, a first end portion 30 and a second end portion 31 would be attached to the support block 19 of the upper tank 11. In the preferred embodiment, the first end portion 30 would be threaded such that it could be screwed into the threaded exit aperture in the support block 19. A lower tank 12 having a cover 32 and a detachable lower portion 38 would be attached to the second end portion 31 of the valve assembly 13. In the preferred embodiment, a ½" thick cover support 33 would be welded to the cover 32 and would contain a threaded aperture for attachment of a threaded second end portion 31 of the valve assembly 13 such that the distal end 39 of the second end portion 31 extended into the lower tank 12.

The preferred embodiment would also contain a U-shaped solvent-resistant seal lip 34 positioned between the cover 32 and the lower portion 38. The use of such a seal 34 would prevent air from leaking between the cover 32 and lower portion 38, thereby forming an air lock in the lower tank 12 above the position where the distal end 39 of the second end portion 31 extends into the lower tank 12. The presence of such an air lock achieves two functions. First, the air lock prevents solvent from being present near the seal 34, and therefore, preventing the possibility of solvent leaking between the cover 32 and lower portion 38. Second, the presence of an air lock at the top of the lower tank 12 also reduces the chance of spilling solvent when detaching the lower portion 38 during the cleaning of the parts washer 10. Those skilled in the art would recognize that other sealing means could be used with the present invention.

The preferred embodiment of the invention would also contain a means for monitoring the amount of dirt that was present in the lower tank 12. In the preferred embodiment, the dirt level would be monitored by use of a sight glass 35 located in an aperture in one of the sidewalls of the lower portion 38 of the lower tank 12. The sight glass 35 would be attached and sealed to the lower portion 38 by use of a mounting flange 36.

The invention would also contain attachment means for attaching and detaching the lower portion 38 to the cover 32. In the preferred embodiment, a plurality of over-center adjustable latches 37 would be used to attach the lower portion 38 to the cover 32. These latches 37 are the preferred means for attaching the lower portion 38 to the cover 32 because they are adjustable to ensure a good seal between the cover 32 and lower portion 38. However, other attachment means could be used with the present invention.

In the preferred embodiment, the upper tank 11, lower tank 12, and valve assembly 13 would be suspended to improve the ease of removing the lower portion 38 of the lower tank 12 for cleaning. The preferred means for suspending the upper tank 11, lower tank 12 and valve assembly 13, would be to attach a plurality of support legs 26 having a length greater than the combined height of the upper tank 11, lower tank 12 and valve assembly 13. The support legs 26 would also preferably have a length of at least 40 inches such that the height of the parts washer 10 would be greater than current parts washer designs, which have a height of 36 inches. The greater height of the preferred embodiment provides easy access to the lower tank 12 for cleaning and enables the user to stand more erect while cleaning parts to limit the amount of back strain on the user.

During operation, parts would be positioned on the cleaning screens 15 inside the parts washer 10. The pump assembly 20 would then be activated such that solvent could be sprayed onto the parts. As the solvent begins to remove the dirt and sludge from the parts, the dirt and sludge from the parts would begin to settle in the bottom of the upper tank 11. Because the upper tank 11 has a sloped bottom portion 16, the sludge and dirt would continue to move downward along the bottom portion 16 until reaching the exit aperture 17. The dirt and sludge would then travel through the valve assembly 13 and into the lower tank 12 where it would begin to accumulate on the bottom of the lower tank 12.

The user would monitor the amount of dirt accumulating in the lower tank 12 by viewing through the sight glass 35. When the desired maximum level of dirt had accumulated in the lower tank 12, the user would turn off the gate valve 29 to prevent any transfer of solvent from the upper tank 11 through the valve assembly 13. The latches 37 would then be released and the lower portion 38 would be removed from the cover 32. The dirt and residual solvent in the lower portion 38 would then be emptied and the lower portion 38 would be re-attached to the cover 32 by re-connecting the latches 37. The gate valve 29 would then be opened, allowing solvent to flow from the upper tank 11 to the lower tank 12. Because an air-tight seal 34 exists between the lower portion 38 and cover 32, an air lock would once again be formed in the upper portion of the lower tank 12. A small amount of solvent would then be added to the upper tank 11 to return the solvent level to the desired amount.

Although characteristics and advantages, together with details for structure, materials, function and process steps, have been described in reference to a preferred embodiment herein, it is understood that the disclosure is illustrative. To that degree, various changes made, especially to matters of shape, size and arrangement, to the full extent extended by the general meaning of the terms in which the appended claims are expressed, are within the principles of the invention.

What is claimed is:

1. A parts washer comprising:

(a) an upper tank having a sloped bottom portion that slopes downward to an exit aperture;

(b) a submersible pump located inside the upper tank for pumping a solvent to a solvent spraying means;

(c) a valve assembly having valve means and first and second end portions, the first end portion being attached to the exit aperture such that there is a fluid-tight seal between the valve assembly and upper tank; and (d) a lower tank having a cover, a detachable lower portion, attachment means for attaching and detaching the lower portion from the cover and sealing means for providing a fluid-tight seal between the cover and lower portion, the cover being attached to the second end portion of the valve assembly such that there is a fluid-tight seal between the cover and valve assembly.

2. A parts washer according to claim 1, wherein the second end portion extends into the lower tank to create an air lock between solvent and dirt located in the lower portion and the cover.

3. A parts washer according to claim 1, wherein the valve assembly is comprised of a solvent rated gate valve.

4. A parts washer according to claim 1, wherein the parts washer further comprises monitoring means for monitoring the amount of dirt in the lower tank.

5. A parts washer according to claim 4, wherein the monitoring means is a sight glass positioned in an aperture in one side of the lower portion such that a user can see into the lower tank.

6. A parts washer according to claim 1, wherein the parts washer further comprises a hinged cover that is attached to the upper tank and that is arranged and configured to seal the upper tank to limit the evaporation of solvent from the upper tank.

7. A parts washer according to claim 1, further including a filter between the submersible pump and spraying means.

8. A parts washer according to claim 7, further including a screen attached to the inlet of the submersible pump to prevent dirt from entering the pump.

9. A parts washer according to claim 1, wherein the attachment means is a plurality of over-the-center adjustable latches.

10. A parts washer according to claim 1, wherein the parts washer further comprises suspension means for suspending the upper tank, valve assembly, and lower tank above the ground, the suspension means being attached to the upper tank.

11. A parts washer comprising:

(a) an upper tank having a sloped bottom portion that slopes downward to a centrally-located exit aperture;

(b) a submersible pump located inside the upper tank for pumping a solvent to a solvent spraying means;

(c) a valve assembly having valve means and first and second end portions, the first end portion being attached to the exit aperture such that there is a fluid-tight seal between the valve assembly and the upper tank;

(d) a lower tank having a cover that is attached to the valve assembly such that there is a fluid-tight seal between the valve assembly and the cover and so that the second end portion of the valve assembly extends into the lower tank, a detachable lower portion having at least one side portion with a sight glass attached to the side portion such that a viewer can view the inside of the lower tank, attachment means for attaching and detaching the lower portion from the cover, and sealing means for providing a fluid-tight seal between the cover and lower portion; and (e) suspension means for suspending the upper tank, valve assembly and lower tank off the ground.

12. A parts washer according to claim 11, wherein the suspension means are a plurality of vertical legs attached to the upper tank having a length that is longer than the cumulative height of the upper tank, valve assembly and lower tank.

13. A parts washer according to claim 11, wherein the parts washer further comprises a hinged cover attached to the upper tank which seals the upper tank to limit evaporation of solvent from the upper tank.

14. A parts washer according to claim 11, wherein the upper tank further comprises a removable reinforced mesh screen that can be attached to the inside of the upper tank below the surface of the solvent to act as a base for soaking parts.

15. A parts washer according to claim 11, wherein the solvent spraying means is a flexible hose and spray nozzle attached to the submersible pump.

16. A parts washer according to claim 11, wherein the upper tank further comprises a support block having an exit aperture that is aligned with the exit aperture in the upper tank and that is arranged and configured to be attached to the first end portion of valve assembly.

17. A parts washer according to claim 11, wherein the lower tank cover further comprises a cover support having an aperture that is arranged and configured to be attached to the second end portion of the valve assembly.

* * * * *